US012044232B2

(12) United States Patent
Aoyagi et al.

(10) Patent No.: US 12,044,232 B2
(45) Date of Patent: Jul. 23, 2024

(54) FLUID MACHINE SYSTEM AND METHOD FOR CONTROLLING SAME

(71) Applicant: Hitachi Industrial Equipment Systems Co., Ltd., Tokyo (JP)

(72) Inventors: Norio Aoyagi, Tokyo (JP); Hiroaki Saito, Tokyo (JP); Fuminori Kato, Tokyo (JP); Daichi Oka, Tokyo (JP); Akihiro Yamamoto, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 404 days.

(21) Appl. No.: 17/274,700

(22) PCT Filed: Nov. 29, 2019

(86) PCT No.: PCT/JP2019/046725
§ 371 (c)(1),
(2) Date: Mar. 9, 2021

(87) PCT Pub. No.: WO2020/129572
PCT Pub. Date: Jun. 25, 2020

(65) Prior Publication Data

US 2022/0049691 A1 Feb. 17, 2022

(30) Foreign Application Priority Data

Dec. 20, 2018 (JP) ..... 2018-237869

(51) Int. Cl.
*F04B 49/06* (2006.01)
*F04B 23/04* (2006.01)
(Continued)

(52) U.S. Cl.
CPC ..... *F04B 49/06* (2013.01); *F04B 23/04* (2013.01); *F04B 23/06* (2013.01); *F04B 41/06* (2013.01);
(Continued)

(58) Field of Classification Search
CPC ..... F04B 49/065; F04B 41/06; F04B 23/06; F04B 49/20; F04B 2203/0214;
(Continued)

(56) References Cited

U.S. PATENT DOCUMENTS 4,502,842 A * 3/1985 Currier ..... F04B 49/065 417/63
5,190,442 A * 3/1993 Jorritsma ..... F04D 15/0083 417/19
(Continued)

FOREIGN PATENT DOCUMENTS

CN 101660529 A 3/2010
CN 105222265 A 1/2016
(Continued)

OTHER PUBLICATIONS

International Search Report (PCT/ISA/210) issued in PCT Application No. PCT/JP2019/046725 dated Mar. 17, 2020 with English translation (four (4) pages).
(Continued)

*Primary Examiner* — Peter J Bertheaud
(74) *Attorney, Agent, or Firm* — Crowell & Moring LLP

(57) ABSTRACT

There are provided an operation number control device and a method for controlling the same that can level the operation times of the fluid machines, which are connected to the operation number control device. A fluid machine system comprises a plurality of fluid machines, and an operation number control device capable of individually controlling start and stop of the fluid machines. The operation number control device sets a continuous operation time for each of the fluid machines based on total operation times of the fluid machine and other fluid machines. When among fluid machines in operation, there is a fluid machine for which the continuous operation time set for the fluid machine has elapsed and there is a fluid machine at stop, the operation
(Continued)

number control device causes the fluid machine at stop to start and causes the fluid machine to stop.

6 Claims, 5 Drawing Sheets

(51) Int. Cl.

| | |
|---|---|
| ***F04B 23/06*** | (2006.01) |
| ***F04B 41/06*** | (2006.01) |
| ***F04B 49/02*** | (2006.01) |
| ***F04B 49/20*** | (2006.01) |
| ***F04D 13/12*** | (2006.01) |
| ***F04D 15/00*** | (2006.01) |
| ***F04D 15/02*** | (2006.01) |
| ***F04D 25/16*** | (2006.01) |
| ***F04D 27/00*** | (2006.01) |
| ***F04D 27/02*** | (2006.01) |
| ***F25B 5/02*** | (2006.01) |
| ***F25B 49/02*** | (2006.01) |

(52) U.S. Cl.
CPC ..... *F04B 49/02* (2013.01); *F04B 49/065* (2013.01); *F04B 49/20* (2013.01); *F04D 13/12* (2013.01); *F04D 15/0066* (2013.01); *F04D 15/0072* (2013.01); *F04D 15/0088* (2013.01); *F04D 15/029* (2013.01); *F04D 25/16* (2013.01); *F04D 27/00* (2013.01); *F04D 27/0261* (2013.01); *F25B 5/02* (2013.01); *F25B 49/022* (2013.01); *F04B 2203/0214* (2013.01); *F04B 2207/043* (2013.01); *F25B 2500/26* (2013.01)

(58) Field of Classification Search
CPC ..... F04B 23/04; F04B 49/02; F04B 49/06; F04B 2207/043; F04D 15/029; F04D 15/0066; F04D 13/12; F04D 15/0088; F04D 15/0072; F04D 25/16; F04D 27/00; F04D 27/0261; F25B 2400/075; F25B 49/022; F25B 2500/26; F25B 5/02
See application file for complete search history.

(56) References Cited

U.S. PATENT DOCUMENTS

| | | | | |
|---|---|---|---|---|
| 7,722,331 | B2 * | 5/2010 | Hirasawa | F04B 41/06 417/5 |
| 9,695,830 | B2 * | 7/2017 | Nakahara | F24F 11/84 |
| 2003/0148850 | A1 | 8/2003 | Tomohiro et al. | |
| 2011/0206541 | A1 | 8/2011 | Yokozawa et al. | |

FOREIGN PATENT DOCUMENTS

| | | | | | |
|---|---|---|---|---|---|
| JP | 58-161011 | A | | 9/1983 | |
| JP | 2003-029802 | A | | 1/2003 | |
| JP | 2006-226530 | A | | 8/2006 | |
| JP | 2007-291857 | A | | 11/2007 | |
| JP | 2008-202555 | A | | 9/2008 | |
| JP | 2009-133253 | A | | 6/2009 | |
| JP | 2011-038434 | A | | 2/2011 | |
| JP | 2015-092083 | A | | 5/2015 | |
| JP | 2009133253 | A | * | 6/2018 | F04B 49/065 |

OTHER PUBLICATIONS

Japanese-language Written Opinion (PCT/ISA/237) issued in PCT Application No. PCT/JP2019/046725 dated Mar. 17, 2020 (four (4) pages).
Chinese-language Office Action issued in Chinese Application No. 201980043786.6 dated Jan. 6, 2022 with English translation (12 pages).
Japanese-language Office Action issued in Japanese Application No. 2018-237869 dated Nov. 22, 2022 with English translation (six (6) pages).
Extended European Search Report issued in European Application No. 19899756.1 dated Jul. 8, 2022 (seven (7) pages).

* cited by examiner

FLUID MACHINE SYSTEM AND METHOD FOR CONTROLLING SAME

TECHNICAL FIELD

The present invention relates to a fluid machine system, particularly to a control method of an operation number control device that controls a plurality of fluid machines.

BACKGROUND ART

An industrial machine such as a gas compression device is a device that requires regular maintenance, and meanwhile, it may be difficult to stop the industrial machine for maintenance depending on a customer that introduces the industrial machine or an application.

For this reason, in order to suppress the frequency of stop of production equipment as far as possible, Patent Document 1 and the like disclose a control method performed by an operation number control device such that a plurality of fluid machines installed can undergo maintenance or be replaced at the same time.

Patent Document 1 describes a method for controlling the number of pumps in operation which controls the number of a plurality of the pumps in operation to control the water level or flow rate. The method for controlling the number of pumps in operation is characterized in that the operation time of each of the pumps is accumulated and the order of operations is determined based on accumulated operation time values to level the operation times and the number of starts of all the pumps.

CITATION LIST

Patent Document

Patent Document 1: JP S58-161011 A

SUMMARY OF THE INVENTION

Problems to be Solved by the Invention

Patent Document 1 is characterized in that when a gas compression device is added due to an increase in usage amount of compressed gas in connection with an increase in production capacity of the equipment or the like, or when the difference of operation time with the device already in use is large and the operation rate is also high, a device having a long operation time frequently repeats operation and stop or a device having a short operation time always continues to operate.

In the gas compression device, for the purpose of preventing the acceleration of wear degradation of a sliding portion caused by a rise in temperature in connection with a continuous operation or the like, when the equipment has spare capacity in its entirety, after a certain time has elapsed, the compression device is rotated to a compression device at stop to be stopped and cooled, so that the life of the component is extended.

In that case, when the operation rate of the equipment in its entirety is high as described above or in operation number control for a plurality of inverter-equipped compression devices, even if a compression device has a long operation time, the compression device is operated for a certain time by rotation, and thus the reduction or leveling of the operation times cannot be realized as expected, the maintenance timings cannot be synchronized, and the like, which are problems.

An object of the present invention is, in light of the above problems, to provide a control method capable of securing the cooling times of all of fluid machines by stop of the operation of the fluid machines while leveling operation times even in operation number control for the fluid machines having different operation times in an operation number control device for the fluid machines.

Solutions to Problems

In order to solve the above problems, the present invention includes a plurality of fluid machines; and an operation number control device capable of individually controlling start and stop of the fluid machines. The operation number control device sets a continuous operation time for each of the fluid machines based on total operation times of the fluid machine and other fluid machines. When among fluid machines in operation, there is a fluid machine for which the continuous operation time set for the fluid machine has elapsed and there is a fluid machine at stop, the operation number control device causes the fluid machine at stop to start and causes the fluid machine to stop.

Effects of the Invention

According to the present invention, it is possible to provide the operation number control device and a method for controlling the fluid machines that can level the operation times while securing the stop time required to cool each of the fluid machines to suppress wear degradation of a sliding component in operation number control for the fluid machines even in the case of a combination of the devices having very much different operation times.

MODE FOR CARRYING OUT THE INVENTION

Hereinafter, embodiments of the present invention will be described with reference to the drawings

First Embodiment

In the present embodiment, an operation number control device for gas compression devices which compress air will be described as an example.

Figure 1:
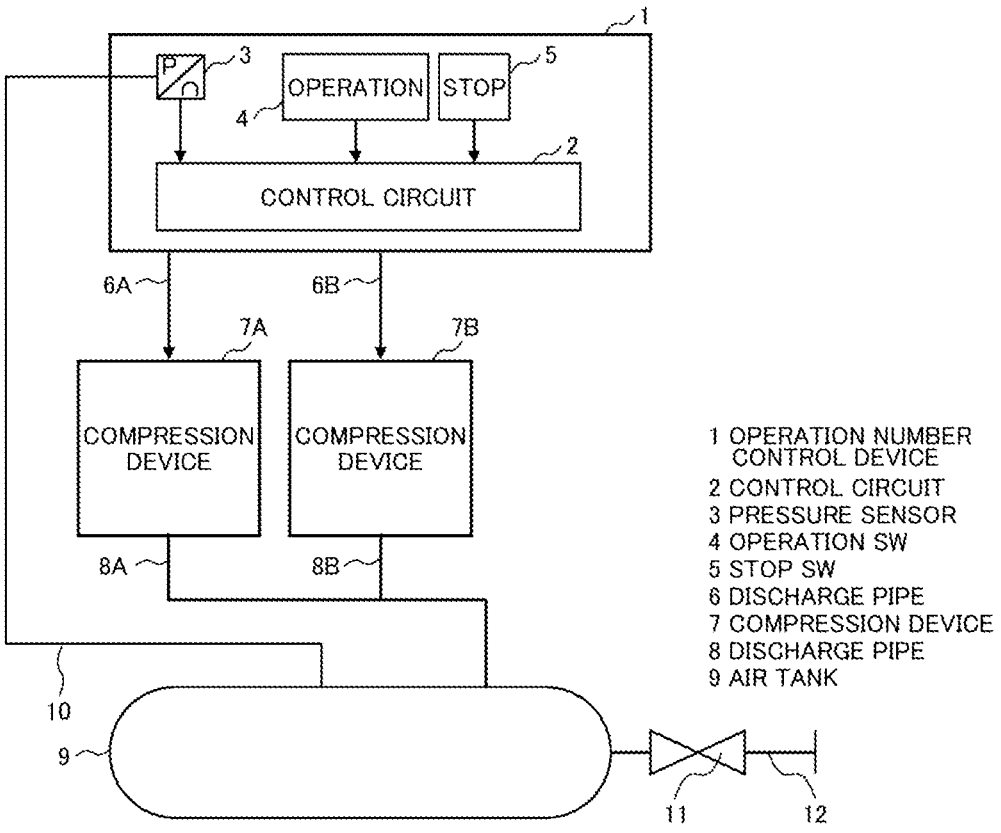
FIG. 1 a diagram describing an operation number control system for existing gas compression devices that is a premise of a first embodiment.

FIG. 1 is a system configuration diagram of the operation number control device for the gas compression devices in the present embodiment. In FIG. 1, compression devices 7A and 7B, an operation number control device 1 that controls the operating states of the compression devices, and a tank 9 that stores compressed gas discharged from the compression devices are schematically configured. The operation number control device 1 includes a pressure sensor 3 that measures the pressure of the compressed gas stored in the tank 9, a control circuit 2 that determines the number of a plurality of the compression devices in operation or the compressor to be operated according to the pressure information, and an operation switch 4 and a stop switch 5 that determine the operating states of all the devices.

When the operation switch 4 of the operation number control device 1 is pressed, the operation number control device 1 causes both or one of the compression devices 7A and 7B to operate, causes the pressure sensor 3 to measure the pressure of the compressed gas that is discharged from the compression devices and stored in the tank 9, and causes the control circuit 2 to increase or decrease the number of the compression devices in operation and to select a compression device to be operated according to the pressure.

Figure 2:
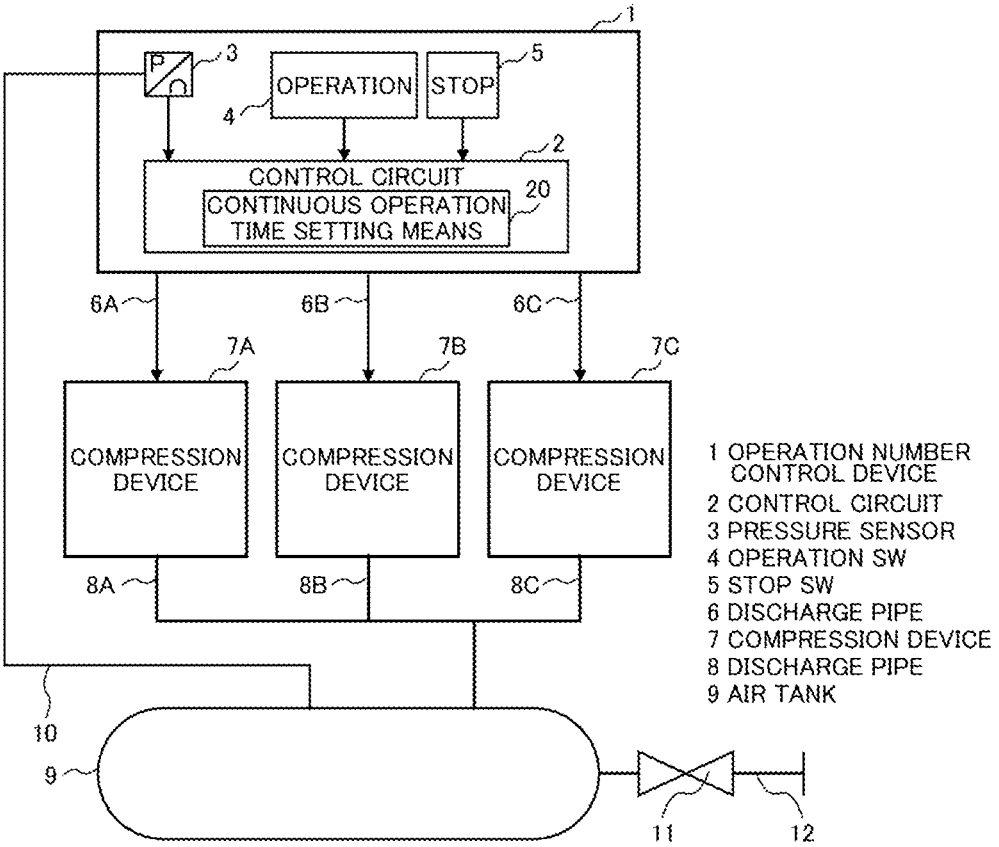
FIG. 2 is a diagram describing the operation number control system after a gas compression device is added in the first embodiment.
Figure 3:
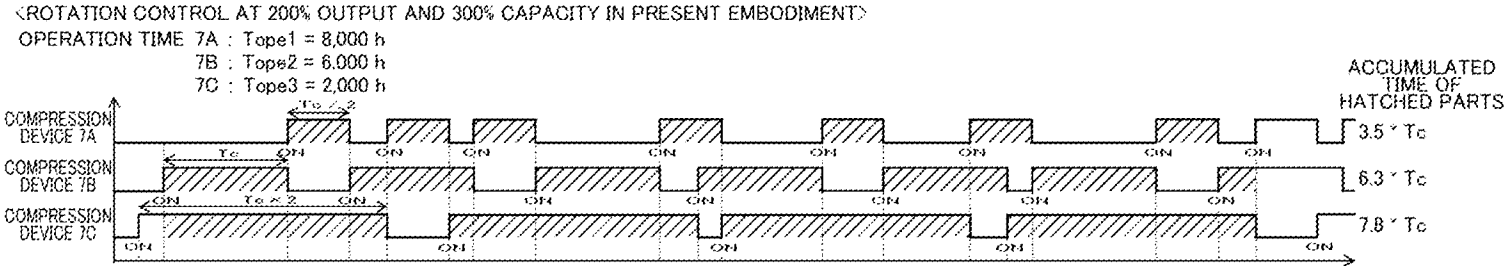
FIG. 3 is an operation pattern chart showing an operation of leveling the operation times of the gas compression devices in the first embodiment.

Next, FIG. 2 is a configuration diagram of an operation number control system of the present invention when a gas compression device 7C is added due to an increase in usage amount of the compressed gas in connection with an increase in production capacity of the equipment or the like. In FIG. 2, continuous operation time setting means 20 is newly operated by the control circuit 2. FIG. 3 shows an operation pattern of the gas compression devices at this time.

First, when the operation switch 4 is pressed to make a request for an operation, the control circuit 2 determines which compression device should be operated before causing the compression device to operate. At this time, since the operation time of the compression device 7C is the shortest and the operation time of the compression device 7A is the longest, the order of start of operation is determined to be 7C, 7B, and 7A. The operation time referred to here represents the total operation time which is the sum of operation times from a predetermined time such as when the compression device 7 is produced or sold to the current time.

Next, the continuous operation time setting means 20 determines the continuous operation time of each of the compressors. At this time, the continuous operation time setting means 20 sets the shortest operation time of the compression device to be longer than a standard operation time Tc set in advance, for example, to Tc×2, and sets the operation time of the compression device having the longest operation time to Tc/2. The continuous operation time referred to here represents the time from the next start of operation of the compression device 7 to the next stop of operation.

Here, in the present embodiment, the case of three compression devices is described as an example; however, two compression devices or four or more compression devices may be provided, and in that case, the shortest and shortest operation times are set to operation times (two times the standard operation time and a half of the standard operation time). However, a predetermined coefficient may be set for each of the numbers of the devices according to the operation time, and only the maximum and minimum operation times may be set to values obtained by multiplying the standard operation time Tc by a specific multiplier or divisor.

Next, the operation of the compression device 7C is started first, and when the pressure measured by the pressure sensor 3 does not reach pressure set in advance, the operation time of the compression device 7B having the next shortest operation time is set to the continuous operation time Tc, and the compression device 7B is started.

Next, when the compressed gas generated and the compressed gas consumed in this state are in balance, the current operation is continued, and when the continuous operation time Tc of the compression device 7B set in advance has elapsed, a process of determining the switching of the compression device is performed. At this time, since the compression device 7A is in a standby state, the control circuit 2 determines that rotation can be performed, and again, the control circuit 2 causes the continuous operation time 20 to recalculate and set the continuous operation time of each of the compression devices from the operation time of each of the compression devices.

Since the compression device 7A has the longest operation time among the three compression devices, the operation of the compression device 7B is stopped at the same time the continuous operation time of the compression device 7A is set to Tc/2 and the compression device 7A is started.

Hereinafter, when the continuous operation time of each of the compression devices 7A, 7B, and 7C has elapsed, the compression device to be started next is controlled according to the pressure and presence or non-presence of the compression device at rest, so that while the leveling of the operation times of the compression devices is realized, the cooling of all the compression devices including also the compression device having a short operation time can be realized with appropriate stop periods, and a premature wear degradation of the compression devices can be prevented. Therefore, the extended life can be expected.

Second Embodiment

Figure 4:
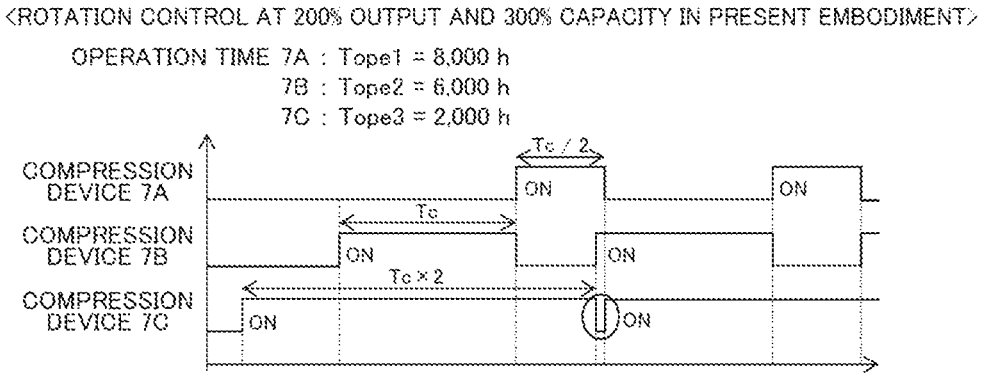
FIG. 4 is an operation pattern chart in a method of the related art in a second embodiment.

In a case where rotation or operation number control is performed in the control of the compression devices, when two compression devices have reached a predetermined operation time substantially at the same time, there is a case where as shown in FIG. 4, the compression device 7C is operated again as a rotation device for the compression device 7A immediately after the compression device 7C is stopped, and thus a sufficient cooling period cannot be secured. At this time, since an operation and a stop operation are performed at a plurality of times for a short time, noise is generated. For this reason, in the present embodiment, even when the compression device has reached a specified operation time set by the continuous operation time setting means 20, in the case of immediately after stop of the rotation device, a function of extending the operation without performing rotation is newly added.

Figure 5:
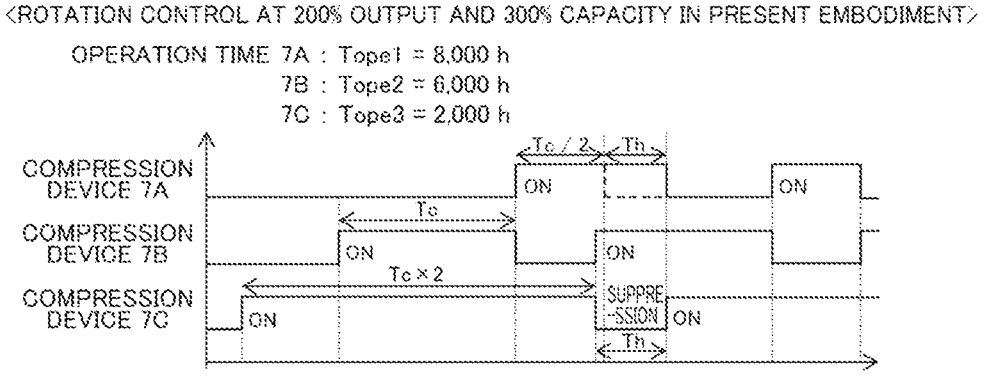
FIG. 5 is an operation pattern chart showing an operation when start suppression control is added in the second embodiment.

The second embodiment will be described with reference to FIGS. 5 and 6. First, in step 11, the continuous operation time setting means 20 determines whether or not the continuous operation time set in advance of any one of the compression devices in operation has elapsed. In the case of YES, the process proceeds to the next step 12 and it is determined whether or not there is a compression device at stop. In the case of being determined to be YES, the process proceeds to step 13 and it is determined whether or not a predetermined stop period Th or more set for the compression device at stop has elapsed. In the case of being determined to be YES in step 13, the process proceeds to step 14 and the rotation process is performed, but in the case of being determined to be No in any one of steps 11 to 13, the process proceeds to step 99 and return is performed without the rotation process being performed.

In the next step 14, the total operation times of all the compression devices connected to the operation number control device 1 are calculated, and the process proceeds to step 15.

In step 15, a compression device having the shortest operation time is selected as a rotation device from the compression devices at stop, and the process proceeds to step 16.

In step 16, it is determined whether or not the operation time of the rotation device selected is the shortest among the compression devices. In the case of YES, the process proceeds to the next step 17, the continuous operation time of the rotation device is set to Tc×2, and the process proceeds to step 18. In the case of No, the process proceeds to the next step 26.

In step 26, it is determined whether or not the operation time of the rotation device is the longest among the compression devices. In the case of YES, the process proceeds to step 27, the continuous operation time of the rotation device is set to Tc/2, and the process proceeds to step 18. In the case of No, the continuous operation time is set to Tc and the process proceeds to step 18.

In the next step 18, a compression device of which the continuous operation time has elapsed is stopped, and the process proceeds to the next step 19. In step 19, the operation of the rotation device is started, the clocking of the continuous operation time determined in the determination process of step 16, 26, or 36 is started, the process proceeds to the next step 99, and return is performed.

Therefore, the operation number control device 1 determines the continuous operation times of the compression devices 7A, 7B, and 7C according to the total operation times to cause the compression devices 7A, 7B, and 7C to operate, and suppresses restart of the operation for the stop time Th during stop, so that while the leveling of the operation times is realized, an appropriate cooling period can be secured.

Third Embodiment

In the related art or in the first and second embodiments, the continuous operation time of the compression device is obtained by multiplying the standard operation time by the coefficient set in advance; however, when the total operation times are very much different from each other, it is also considered a case where the leveling of the operation times of the compression devices is not completed until a compression device having the longest total operation time reaches maintenance time. Therefore, in a third embodiment, remaining times $T_{remain}$ from the total operation times to maintenance of the compression devices each are calculated, an average remaining time $T_{remain_ave}$ is calculated, and the operation times of the compression devices each are determined from a ratio between the remaining times $T_{remain}$ and the average remaining time, and thus control can be performed such that the leveling of the total operation times of the compression devices is completed before the compression device having the longest total operation time reaches the maintenance time.

Specifically, first, Equation (1) is computed to calculate the remaining time $T_{remain}$ to maintenance of each of the compression devices.

[Equation 1]

$$T_{remain}=T_{mnt}-T_{ope} \quad (1)$$

Here, $T_{mnt}$ is maintenance time and $T_{ope}$ is the operation time of the compression device.

Next, the average remaining time $T_{remain_ave}$ of the entirety of the compression device system is obtained from the remaining times $T_{remain}$ of the compression devices. Namely, Equation (2) is computed.

[Equation 2]

$$T_{remain_ave}=T_{remain_7A}+T_{remain_7B}+T_{remain_7C})/3 \quad (2)$$

Here, $T_{remain_7A}$ is the remaining time of the compression device 7A, $T_{remain_7B}$ is the remaining time of the compression device 7B, and $T_{remain_7C}$ is the remaining time of the compression device 7C.

Then, a continuous operation time $T_{run_long}$ is obtained from the remaining time $T_{remain}$ and the average remaining time $T_{remain_ave}$ for a compression device having the shortest operation time. Namely, Equation (3) is computed.

[Equation 3]

$$T_{run_long}=T_{remain}/T_{remain_ave}\times k\times Tc \quad (3)$$

Here, $T_{run_long}$ is the continuous operation time of the compression device having a short operation time, k is an acceleration coefficient, and Tc is the standard continuous operation time.

However, when the result of the computation of Equation (3) exceeds the maximum operation time assumed for the compression device, the operation time is fixed at a predetermined continuous operation time $T_{run_max}$.

Next, a continuous operation time $T_{run_short}$ is obtained from the remaining time $T_{remain}$ and the average remaining time $T_{remain_ave}$ for a compression device having the longest operation time. The computational equation at this time is expressed as Equation (4).

[Equation 4]

$$T_{run_short}=T_{remain}/T_{remain_ave}/k\times Tc \quad (4)$$

However, when the result of the computation of Equation (4) is smaller than the minimum operation time assumed for the compression device, in order to prevent the operation from ending in a very short time, the operation time is fixed at a predetermined continuous operation time $T_{run_min}$, so that noise and annoying sound caused by frequent rotation of the compression devices, damage to an electric circuit caused by an inrush current, or contact wear of an electromagnetic contactor is prevented.

Then, continuous operation times $T_{run}$ are obtained using Equation (5) for the remaining compression devices.

[Equation 5]

$$T_{run}=T_{remain}/T_{remain_ave}\times Tc \quad (5)$$

Figure 6:
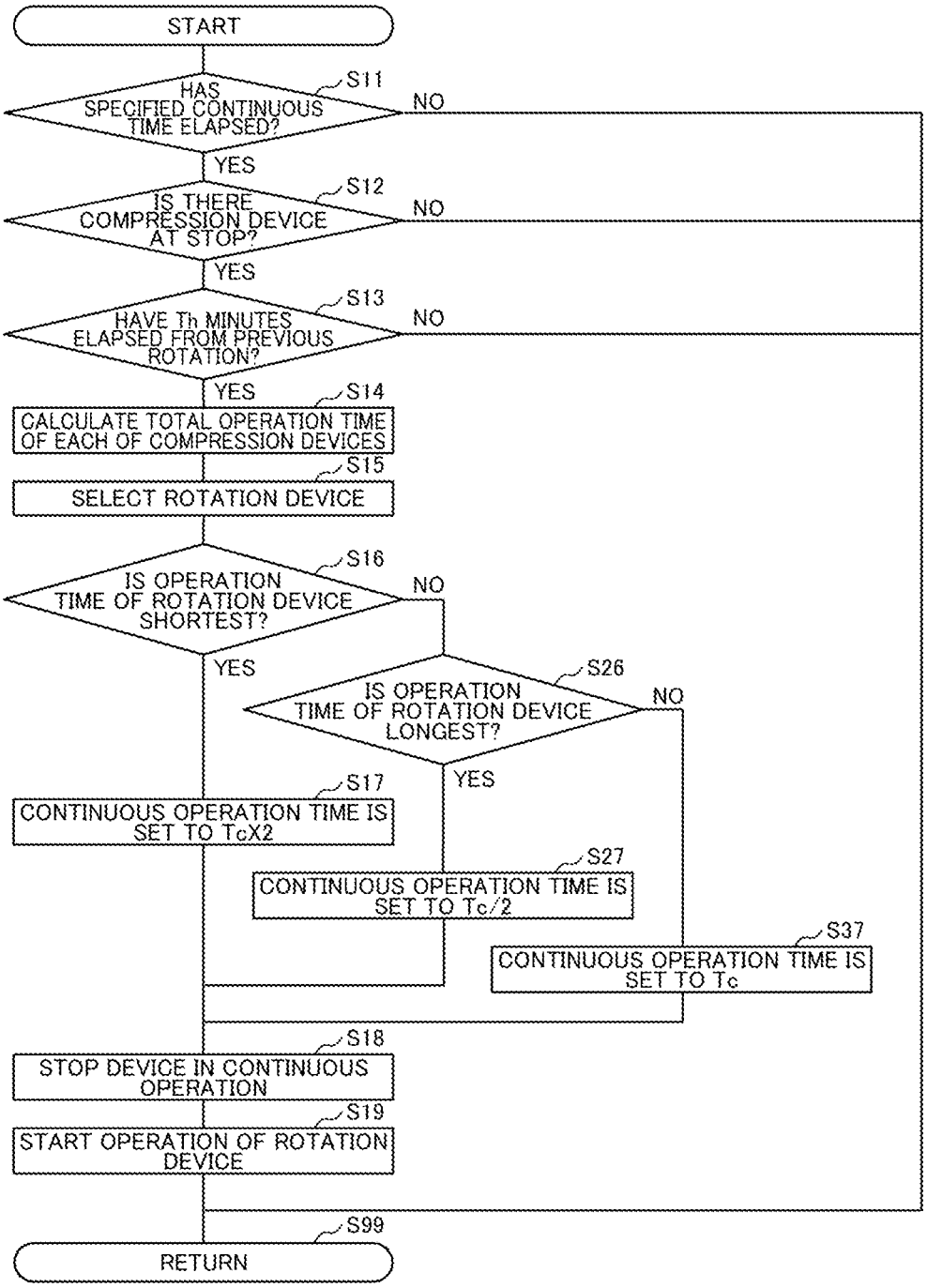
FIG. 6 is a flowchart illustrating a process of selecting a rotation device from compression devices, setting continuous operation times, and performing the start suppression control when the start suppression control is added in the second embodiment.

Then, Tc×2, Tc/2, and Tc in steps 17, 27, and 37 of FIG. 6 are replaced with the continuous operation times $T_{run}$, namely, $T_{run_long}$, $T_{run_short}$, $T_{run}$ obtained in Equations (3), (4), and (5), and the operation is controlled.

Therefore, according to the present invention, even in the operation number control for a combination of the compression devices having very much different operation times, the compression device having a short operation time can be continuously operated preferentially and for a longer time than the other compression devices, and it is possible to provide the operation number control device and a method for controlling the compression devices that can level the operation times to the maintenance times in the operation number control device for the compression devices.

In the above embodiments, whether the operation number control device 1 and the plurality of compression devices 7 are contained in one package as a product or a system in which products contained in a plurality of packages are combined is not particularly limited. Namely, the control described in the above embodiments is performed on the product including the operation number control device 1 and the plurality of compression devices 7 in one package, so that for example, when one compression device 7 is replaced due to a failure or when the compression device 7 is added to a space that is empty at the time of sale, the compression devices 7 can be operated such that the operation times of the compression devices 7 are leveled. In addition, when the compression device 7 which is a package type is newly added to an environment where one or more compression devices 7 which are a package type are already operated, or the like, the operation number control device 1 which is a package type can be introduced to cause the compression devices 7 to operate such that the operation times of the compression devices 7 are leveled.

Particularly, in the case of a system in which the operation number control device 1 and the plurality of compression devices 7 are all formed as separate products, each of the compression devices 7 includes a control substrate, but is configured to operate as described in the present embodiments according to an operation or stop signal or the like from the control circuit 2 provided in the operation number control device 1. In addition, each of the compression devices 7 may be configured to transmit a current operating status or information regarding operation time via a communication line through which a start or stop signal and the like from the operation number control device 1 are received. The operation number control device 1 may be configured to count the operation time of each of the compression devices 7 based on the premise that a user inputs the operation time of each of the compression devices 7 into the operation number control device 1 during construction of the system and each of the compression devices 1 operates according to a start or stop signal from the operation number control device 1 after the system is constructed.

Incidentally, the present invention can be adopted in a compression device system or in a package of compression devices including a plurality of compression devices such as a twin or single screw type, a reciprocating type, or a turbo type. In addition, the present invention can also be adopted in a compression device that compresses a mixed gas such as air or a compression device that compresses a single gas such as nitrogen gas or oxygen gas, as the compression device. Further, the present invention can be adopted in a system or package including a plurality of fluid machines such as chillers or pumps including the same mechanism, other than the compression device.

Incidentally, the present invention is not limited to the above-described embodiments, and includes various modification examples. For example, the above-described embodiments have been described in detail to describe the present invention in an easy-to-understand manner, and the present invention is not necessarily limited to including all the configurations described. In addition, a part of the configuration of an embodiment can be replaced with the configuration of another embodiment, and the configuration of another embodiment can be added to the configuration of an embodiment. In addition, other configurations can be added to, removed from, or replaced with a part of the configuration of each of the embodiments.

REFERENCE SIGNS LIST

1 Operation number control device
2 Control circuit
3 Pressure sensor
4 Operation switch
5 Stop switch
7 Compression device
9 Air tank
20 Continuous operation time setting means

The invention claimed is:

1. A fluid machine system comprising:
a plurality of fluid machines; and
an operation number control device capable of individually controlling start and stop of the fluid machines,
wherein the operation number control device determines an order of operation start of the fluid machines in ascending order of total operation time of each fluid machine,
sets a continuous operation time for each of the fluid machines based on total operation times of each of the fluid machines such that the continuous operation time of one of the plurality of fluid machines having a first total operation time is longer than the continuous operation time of another of the plurality of fluid machines having a second total operation time that is longer than the first total operation time,
starts the operation of each of the plurality of fluid machines until a preset value is reached in accordance with the determined order of operation start of each fluid machine; and
when there is a fluid machine for which the continuous operation time set for the fluid machine has elapsed among fluid machines in operation and there is a fluid machine at stop, the operation number control device causes the fluid machine at stop to start and causes the fluid machine for which the continuous operation time has elapsed to stop.

2. The fluid machine system according to claim 1,
wherein in setting the continuous operation time of each of the fluid machines, the operation number control device sets the continuous operation time of each of the fluid machines before a fluid machine having a longest total operation time reaches a maintenance time.

3. The fluid machine system according to claim 1,
wherein when the fluid machine system starts, the operation number control device causes a fluid machine having a longest continuous operation time to start first.

4. A method for controlling a fluid machine system including a plurality of fluid machines and an operation number control device capable of individually controlling start and stop of the fluid machines, the method comprising:
the operation number control device determining an order of operation start of the fluid machines in ascending order of total operation time of each fluid machine,
setting a continuous operation time for each of a plurality of fluid machines based on total operation times of each of the fluid machines such that the continuous operation time of a fluid machine having a first total operation time is longer than the continuous operation time of a fluid machine having a second total operation time that is longer than the first total operation time,
starting the operation of each of the fluid machines until a preset value is reached in accordance with the determined order of operation start of the fluid machine; and
when there is a fluid machine for which the continuous operation time set for the fluid machine has elapsed among fluid machines in operation and there is a fluid machine at stop, causing a fluid machine at stop to start and causing the fluid machine for which the continuous operation time has elapsed to stop.

5. The method for controlling a fluid machine system according to claim 4, wherein in setting the continuous operation time of each of the fluid machines, the continuous operation time of each of the fluid machines is set before a fluid machine having a longest total operation time reaches a maintenance time.

6. The method for controlling a fluid machine system according to claim 4, wherein when the fluid machine system starts, a fluid machine having a longest continuous operation time is started first.

* * * * *